United States Patent [19]

Shulver

[11] Patent Number: 4,677,418

[45] Date of Patent: Jun. 30, 1987

[54] IGNITION CABLE

[75] Inventor: William Shulver, Lincoln, R.I.

[73] Assignee: Carol Cable Company, Pawtucket, R.I.

[21] Appl. No.: 675,692

[22] Filed: Nov. 28, 1984

Related U.S. Application Data

[63] Continuation-in-part of Ser. No. 560,546, Dec. 12, 1983, abandoned.

[51] Int. Cl.[4] ..... H01C 3/06

[52] U.S. Cl. ..... 338/214; 338/66; 174/102 R; 174/102 SC; 174/107; 174/109

[58] Field of Search ..... 338/214, 66; 427/178; 174/102 R, 775, 107-109, 120 R, 120 SC, 205 R, 110 R, 105 R; 264/22

[56] References Cited

U.S. PATENT DOCUMENTS

| | | | |
|---|---|---|---|
| 3,031,523 | 4/1962 | Howard | 174/102 R |
| 3,244,799 | 4/1966 | Roberts | 174/107 |
| 3,260,636 | 7/1966 | Witzenmann | 174/102 R X |
| 3,651,244 | 3/1972 | Silver et al. | 74/105 R |
| 3,849,591 | 11/1974 | Ichiba et al. | 74/110 R |
| 3,870,987 | 3/1975 | Wiley et al. | 338/214 |
| 3,928,519 | 12/1975 | Kashiyama et al. | 74/110 R |
| 4,330,493 | 5/1982 | Miyamoto et al. | 264/22 |
| 4,363,019 | 12/1982 | Miyamoto et al. | 338/214 |
| 4,366,464 | 12/1982 | Miyamoto et al. | 338/214 |

*Primary Examiner*—E. A. Gondborg
*Assistant Examiner*—M. N. Lateef

[57] ABSTRACT

An ignition cable in which a thin tape or film of ethylene terephthalate is wrapped tightly around an inner layer of rubber insulation, coaxial with the core and inside the outer insulating jacket.

13 Claims, 2 Drawing Figures

IGNITION CABLE

CROSS REFERENCE TO RELATED APPLICATION

This application is a continuation-in-part of Ser. No. 560,546, filed Dec. 12, 1983 and now abandoned.

FIELD OF INVENTION

This invention relates to ignition cables.

BACKGROUND OF INVENTION

The usual automotive ignition cable includes a central core of glass filaments, bonded together with a conductive material (e.g., an acrylic latex or silicone dispersion) and surrounded by one or more layers of coaxial rubber insulation. To provide the required cable strength and flexibility, a glass fiber overbraid generally is provided coaxially over the inner insulation layer and an outer layer of rubber insulation is extruded coaxially over it.

Such glass overbraids are expensive to make, difficult to handle, and time-consuming to include in a cable. Nonetheless, inclusion of such braids has normally been necessary to insure that the ignition cable has the requisite strength, useful life, and other proprities.

SUMMARY OF INVENTION

The present invention provides an automotive ignition cable of equivalent or superior strength, useful life and other electrical properties, but that requires no glass overbraid. Because no such braid is required, the cable is less expensive and can be produced both more quickly and economically.

The invention features an ignition cable in which a reinforcing electrically insulating film or tape is wrapped tightly around an inner layer of rubber insulation, coaxial with the core and inside the outer insulating jacket. In preferred embodiments, the film is of ethylene terephtalate, is about 1 mil thick, and is wrapped longitudinally around the inner insulation layer in such a manner as to provide an overlapped seam about ⅛ inch wide, and bonds lightly to both the inner insulating layer and the outer insulating jacket.

BRIEF DESCRIPTION OF THE DRAWING

In the two drawings, parts of the cable shown in one that are identical to corresponding parts of the cable shown in the other are identified by the same reference numbers.

DESCRIPTION OF PREFERRED EMBODIMENTS

Figure 1:
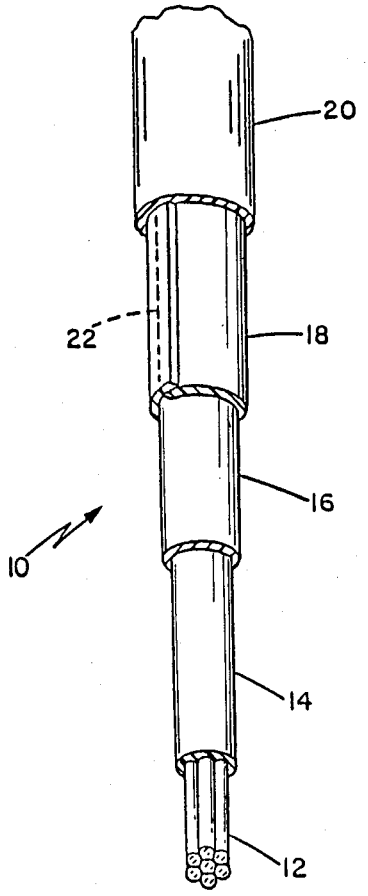
FIG. 1 is a perspective view, partially in section, of a flexible ignition cable constructed in accord with the present invention.
Figure 2:
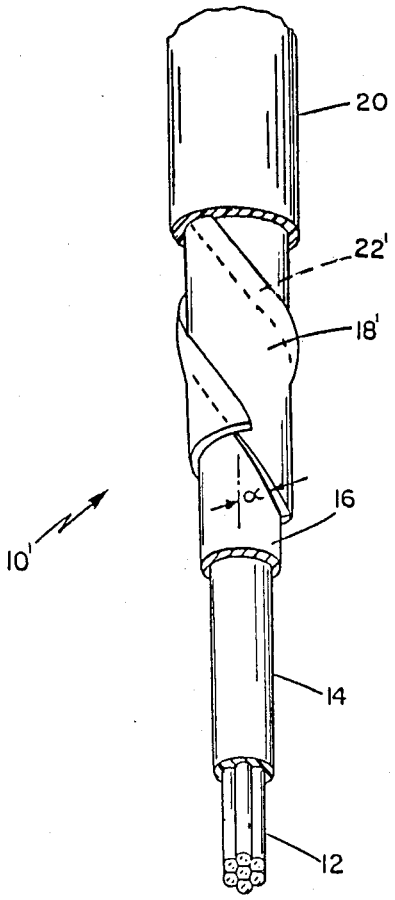
FIG. 2 is a perspective view, partially in section, of another ignition cable embodying the present invention.

As shown in the drawings, an automotive ignition cable, generally designated 10 in FIG. 1 and 10' in FIG. 2, has at its center a plurality of individual elements of glass fibers 12 impregnated and bonded together with a layer 14 of a conductive acrylic latex (or, alternatively, a conductive silicone dispersion rubber such as that sold by Dow-Corning Corp.) A layer 16 of insulating rubber, typically a hi-dielectric styrene butadiene rubber, is extruded directly over the outer cylindrical surface of conductive layer 14 so that the adjacent surfaces of the two layers, the outer surface of conductive layer 14 and the inner layer of insulating layer 16, tightly engage each other in an essentially airtight manner.

In conventional automative cables, a glass fiber overbraid is applied coaxially over insulating layer 16. In the cable of the present invention, the glass overbraid is omitted and, in its place, a tape or film (designated 18 in FIG. 11 and 18' in FIG. 2) of ethylene terephthalate (e.g. DuPont Mylar) is wrapped tightly around the cylindrical outer surface of insulating layer 16, using conventional wrapping methods and equipment. An insulating rubber outer jacket 20, typically chlorinated polyethylene, is then extruded over the essentially cylindrical layer of wrapped Mylar film, and forms the outer layer of the cable. The tape 18, thus, is in essentially air-tight face-to-face engagement with, and typically bonds at least lightly to, both underlying insulation layer 16 and outer jacket 20; and the interfaces between the adjacent layers are free from voids or air pockets.

In the FIG. 1 embodiment, the Mylar tape or film 18 is about 1 mil thick and is wrapped longitudinally around inner layer 16, much like cigarette paper. The longitudinal edges of the film overlap and form a longitudinally-extending overlapped seam 22, about ⅛ inch wide. The tape 18 is about 1 inch wide, but as will be recognized the exact width of the tape required will depend on the width of seam desired and the diameter of the cable. When, as in the illustrated embodiment, the cable 10 is a conventional automobile ignition cable, typically having an overall diameter of either 7 or 8 milimeters (about 0.275 or 0.315 inches, respectively) depending on the manufacture of the automobile for which it is intended and inner layer 16 has a diameter about 0.050 inch less than the overall diameter of the cable, a tape about 1 inch wide will provide a seam having the minimum desired width, about ⅛ inch.

In the FIG. 2 embodiment, the Mylar film 18' is wrapped helically around the outer surface of inner layer 16, again in such a way so that the edges of adjacent turns will overlap each other and form a helical overlapped seam 20' not less than about ⅛ inch wide. As will be evident to those working in the field, the necessary width of the wrap depends not only on the cable diameter but also on the angle, $\alpha$, of wrap relative to the cable central axis. In the illustrated embodiment, the angle of wrap is about 30 degrees and the tape width is about equal to the diameter of the inner layer 16 about which it is wrapped. For smaller angles of wrap, a wider tape will be required to provide the desired about ⅛ inch minimum overlap; for larger angles, the width of the tape may be less.

In both embodiments, and as shown in the drawings, the Mylar film layer completely and tightly surrounds the underlying cylindrical layer of insulation 16, and is in turn completely and tightly surrounded by the outer jacket 20. Because Mylar film 18 is flexible and, typically, only about 1 mil thick, the inner and outer surfaces of the film are essentially smooth cylinders in tight face-to-face, essentially void-free and airtight engagement with the inner insulation 16 and outer jacket 20. The overlapped portions of the film forming seams 22, 22' slightly adhere to each other, and, in the preferred embodiments, the film also bonds lightly to both the inner insulation 16 and outer jacket 20. The Mylar film both provides a moisture barrier and imparts mechanical strength to the overall cable, the incidence of voids is greatly decreased, and the dielectric properties of the cable improve also. Particularly with the FIG. 1 embodiment, the outer surface of outer insulating layer 20 is smoother than can normally be achieved with cable having a conventional glassbraid.

OTHER EMBODIMENTS

In other embodiments, the Mylar film or tape may be from about ½ mil to about 2 mils thick. If a wider seam 22, 22' (or even a tape layer 18 of double thickness) is desired, the width of the tape used, particularly in longitudinal wrap embodiments such as shown in FIG. 1, may be considerably greater, e.g., for a double thickness layer in a 7 millimeter (0.27559 inches) cable, the tape width will be about 1½ inch, about twice the circumference of the inner insulating layer 16. For particular applications, the tape or film may be scrim-reinforced. Similarly, an electrical grade tape comprising an electrically-insulating thermoplastic material having good electrical and mositure resistant properties may be employed in lieu of ethylene terephthalate film.

These and other embodiments will be within the scope of the following claims.

What is claimed is:

1. A flexible ignition cable comprising:

an electrically conductive core;

a first insulation layer extruded over and coaxially surrounding said core and having a generally cylindrical outer surface;

a reinforcing layer comprising a thin elongated tape of ethylene terephthalate wrapped coaxially around said first insulation layer and forming an essentially cylindrical layer tightly engaging and bonded to the outer cylindrical surface of said first insulation layer; and, a second layer of insulation extruded over and coaxially surrounding, tightly engaging and bonded to the outer essentially cylindrical surface of said reinforcing layer, the adjacent edges of the said tape forming said reinforcing layer overlapping each other to provide an overlapping seam not less than about ⅛ inch wide, said overlapping edge portions being at least slightly adherent to each other, and the cylindrical interfaces between said reinforcing layer and each of said insulation layers being essentially air and moisture tight and void-free.

2. The cable of claim 1 wherein said tape is wrapped longitudinally around said first insulation layer.

3. The cable of claim 1 wherein said tape is wrapped helically around said first insulation layer.

4. The cable of claim 1 wherein said tape is not less than about 1 mil thick.

5. The cable of claim 1 wherein the thickness of said tape is in the range of about 1 mil to about 2 mils, and the width of said tape is such that the width of said seam is not less than about 1/18 inch and not more than about the circumference of said cable.

6. In flexible ignition cable comprising an electrically conductive core, a first insulation layer extruded over and coaxially surrounding and tightly engaging said core and having a generally cylindrical outer surface, a reinforcing layer surrounding said first insulation layer and core and engaging the outer cylindrical surface of said first insulation layer, and a second layer of insulation coaxially surrounding and engaging said reinforcing layer, that improvement wherein:

said reinforcing layer comprises an elongated electrically insulating tape wrapped tightly and coaxially around said first insulation layer with the adjacent edges thereof overlapping each other such that said tape provides a cylindrical layer in which said overlapping edges form a seam wherein said overlapping edge portions of said tape are at least slightly adherent to each other, said reinforcing layer being bonded to said layers of insulation such that the cylindrical interfaces between said reinforcing layer and said layers of insulation are essentially air and moisture-tight and void-free.

7. The cable of claim 6 wherein said tape comprises a thermoplastic electrically and moisture resistant material.

8. The cable of claim 7 wherein said reinforcing tape comprises a film of ethylene terephthalate.

9. The cable of claim 6 wherein the thickness of said tape is in the range of about 0.5 to about 4.0 mil thick.

10. The cable of claim 6 wherein said tape is about 1 mil thick.

11. The cable of claim 6 wherein the width of said seam is not less than about ⅛ inch and not more than about the circumference of said first insulation layer.

12. The cable of claim 6 wherein said seam has a width of about ⅛ inch.

13. The cable of claim 6 wherein said tape is non-porous organic plastic and is at least slightly adherent to each of said first and second layers of insulation.

* * * * *

UNITED STATES PATENT AND TRADEMARK OFFICE

CERTIFICATE OF CORRECTION

PATENT NO. : 4,677,418

DATED : June 30, 1987

INVENTOR(S) : William Shulver

It is certified that error appears in the above-identified patent and that said Letters Patent is hereby corrected as shown below:

Column 1, line 26, "proprities" should read --properties--.

Column 4, line 8, "1/18" should read -- 1/8 --.

Signed and Sealed this

Eighth Day of December, 1987

*Attest:*

DONALD J. QUIGG

*Attesting Officer*

*Commissioner of Patents and Trademarks*